US005290043A

United States Patent [19]

Vidinic

[11] Patent Number: 5,290,043

[45] Date of Patent: Mar. 1, 1994

[54] GAME FOR PRACTICING SOCCER SKILLS

[76] Inventor: Blagoje Vidinic, 1B Rene Hirschler, 67000 Strasbourg, France

[21] Appl. No.: 62,967

[22] Filed: May 14, 1993

[51] Int. Cl.[5] ..... A63B 63/00; A63B 69/00

[52] U.S. Cl. ..... 273/411; 273/371; 273/DIG. 18; 273/DIG. 26; 273/DIG. 30

[58] Field of Search ..... 273/411, 398, 371, 400, 273/401, 402, DIG. 17, DIG. 18, DIG. 26, DIG. 30; 434/260

[56] References Cited

U.S. PATENT DOCUMENTS

| | | | |
|---|---|---|---|
| 3,258,858 | 7/1966 | Cariffe, Jr. | 434/260 X |
| 3,822,883 | 7/1974 | De Vos . | |
| 3,856,298 | 12/1974 | Frantti | 273/402 X |
| 3,920,245 | 11/1975 | Gothreaux | 273/411 X |
| 4,284,277 | 8/1981 | Leonard | 273/411 |
| 4,286,786 | 9/1981 | Papadopoulos | 273/396 |
| 4,335,881 | 6/1982 | Warehime | 273/411 X |
| 4,352,497 | 10/1982 | Warehime | 273/411 |
| 4,497,492 | 2/1985 | Lehman | 273/411 |
| 4,523,726 | 6/1985 | Swisher | 242/84.2 |
| 4,699,386 | 10/1987 | Carzino | 273/411 X |
| 4,702,475 | 10/1987 | Elstein | 273/29 A X |
| 4,792,144 | 12/1988 | LaDue | 273/411 |
| 4,865,330 | 9/1989 | D'Amico | 273/411 |
| 4,921,257 | 5/1990 | Heller | 273/401 |
| 4,948,147 | 8/1990 | Pallanca | 273/402 |
| 5,054,791 | 10/1991 | Ball | 273/396 |
| 5,082,291 | 1/1992 | Appel et al. | 273/346 |
| 5,181,725 | 1/1993 | Leras et al. | 273/402 |

*Primary Examiner*—William H. Grieb

[57] ABSTRACT

A game for improving soccer skills is provided which has a target preferably in the shape of a soccer goal. The target has a number of different sections which correspond to different point values based on the degree of difficulty in reaching the particular section The section boxes should be differentiated from one another in an easily identifiable manner, such as by color. Another element of game involves providing a mechanism for coordinating the different sections of the target to a particular section of the foot. This may be done, for example, by providing a shoe with different colored designations for various locations on the shoe. To play the game, one or more players take turns kicking a soccer ball from a set distance at the target. The player chooses which target section will be aimed for and takes notice of the color of the section. The player then kicks the ball with the portion of the shoe having the color which matches the chosen section. If the player hits the matching section of the target, the player receives the indicated value of points.

18 Claims, 2 Drawing Sheets

GAME FOR PRACTICING SOCCER SKILLS

BACKGROUND OF THE INVENTION

This invention relates to a game for the development of soccer skills. More particularly, the invention relates to a game wherein a person can achieve points by kicking a soccer ball with a designated part of the foot against a designated section of a target coordinated to that part of the foot.

In the game of soccer, it is important to be able to control the soccer ball with the foot. It is a great advantage if a player can control the ball using the various portions of the foot, such as the inside, outside, and instep, with accuracy. This allows for the player to be able to quickly react to a ball coming from any direction, and just as quickly, to deliver the ball to a new location without the need to reposition.

One of the principle reasons that soccer is the most popular sport worldwide, and has the fastest growing participation among young people in the United States, is the low equipment cost compared to other participant sports. The only real need is the soccer ball itself. Therefore, it is important that a mechanism which aids a person in improving their soccer skills is also simple and economical.

It is therefore an object of this invention to provide a game for improving soccer skills which is simple and economical.

It is a further object of this invention to provide a game in which players will develop an important skill while enjoying the fun of competing for points.

SUMMARY OF THE INVENTION

A game for improving soccer skills is provided which comprises a target to be installed in a vertical position. The target may be preferably in the shape of a soccer goal, that is, a rectangle having a length slightly less than twice its height. The target has indicated thereon a number of sections, which may be in the form of square or rectangular boxes printed on the surface of the target. The different sections correspond to different point values based on the degree of difficulty in reaching the particular section. Preferably, higher points are awarded for hitting sections farther from the location of the kicker. The point values may be indicated within the various sections. The section boxes should be differentiated from one another in an easily identifiable manner, such as by color.

The game further comprises a means for coordinating the different sections of the target to a particular section of the foot. This may be done, for example, by providing a shoe with different designations for various locations on the shoe. For example, one may use a shoe having different colored sections which correspond to the colors of the target. Alternatively, means may be provided so that an ordinary shoe may be adapted to play the game. For example, colored attachments, such as stickers, may be provided for attachment to the shoe. The colored attachments may also be materials having a Velcro® backing which can be fastened to corresponding Velcro® strips on the shoe.

In one embodiment for playing the game of the invention, one or more players take turns kicking a soccer ball from a set distance at the target. The player chooses which target section will be aimed for and takes notice of the color of the section. The player then kicks the ball with the portion of the shoe having the color which matches the chosen section. If the player hits the matching section of the target, the player receives the indicated value of points. The game is continued until a certain number of points is reached by one of the players, or is played for a fixed number of turns with the player having the highest total being the winner.

In another embodiment for playing the game the kicking location comprises a straight line parallel to and at a set distance from the target, but varies from side to side depending on which target section is chosen. For example, for kicking toward target sections indicated by higher point values, usually located toward the outer side edges of the target, the kicking locations are positioned to provide maximum distance and angle. In other words, for a target section on the extreme right hand side of the target, a kicking location is provided on the extreme left hand side of the kicking line facing the target.

DETAILED DESCRIPTION OF THE INVENTION

Figure 1:
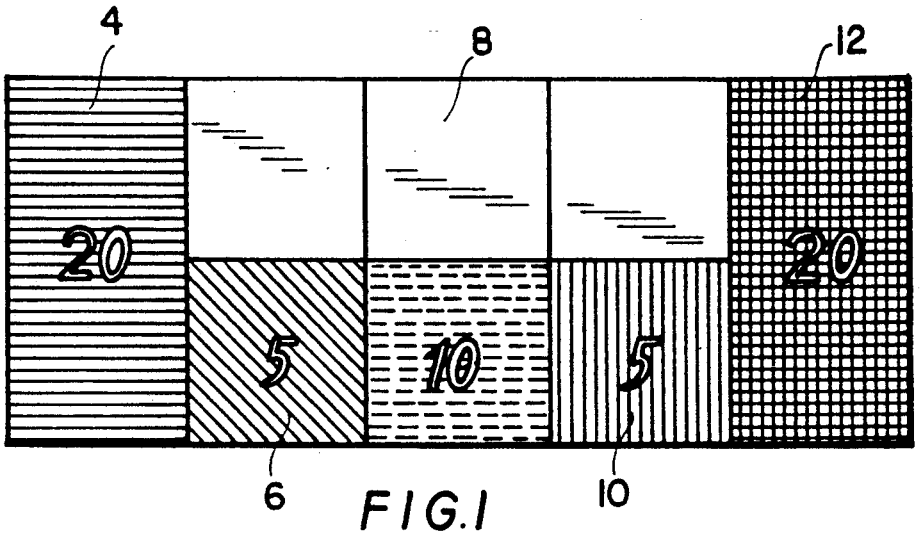
FIG. 1 is a plan view of an embodiment of a target used in the game of invention.
Figure 5:
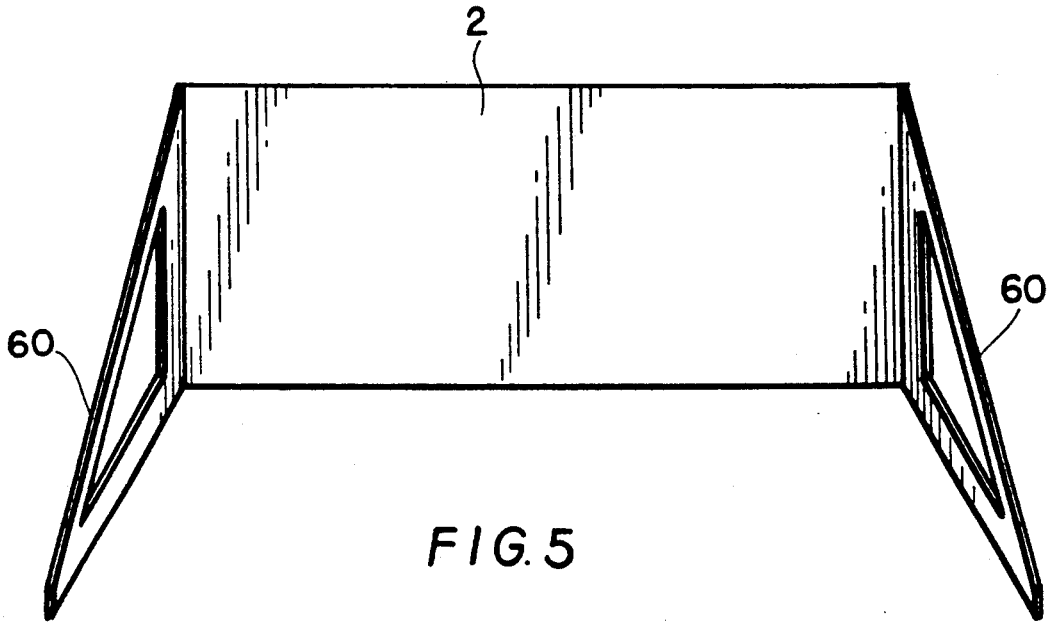
FIG. 5 is a perspective rear view of an alternate embodiment of a target having support means.

With reference to the drawings and in particular FIG. 1, a preferred embodiment of the invention is described. The target 2 is made of a durable but flexible sheet or cloth, which can withstand the pressure of ball being kicked against it, and can be easily folded for storage. The target 2 may preferably be deployed perpendicular to the ground by fixing it to a wall or by suspending it on side posts and a cross bar, as are present in an existing soccer goal. Alternatively, as seen in FIG. 5, the target may be made of a rigid, lightweight material such as sheet metal, and be provided with means 60 for supporting the target in a free-standing position able to withstand the force of a kicked ball.

Figure 3:
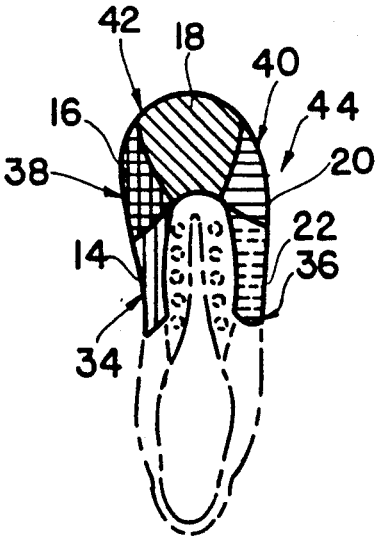
FIG. 3 is a perspective view of a shoe especially adapted for use in the game of the invention.

Though the target may be of any convenient shape or size, it most advantageously resembles a soccer goal, having a length of approximately 111 cm and a height of approximately 60 cm. In a preferred embodiment, the target is divided into five longitudinal sections 4,6,8,10,12 corresponding to the five sections on the shoe. Though other numbers of sections are possible, five is the most practical for delineating the shoe into easily distinguishable portions, as shown in FIG. 3. The target sections are preferably arranged in a symmetrical fashion about the vertical center line of the target so as to encourage the use of both sides of the foot by the player. The five target sections 4,6,8,10,12 and corresponding shoe portions 14,16,18,20,22 are each a different color (indicated in the figures by cross-hatching). Though the colors of the shoe portions in FIGS. 3 and 4 as drawn correspond to certain target sections, it should be understood that the invention is not limited to the particular arrangement shown. Alternative embodiments may include corresponding designs or numbers between the target sections and shoe portions in place of colors. In the target of FIG. 1, the outer sections 4,12 run the entire height of the target, while the inner sections 6,8,10 run only to about the center height line of the target 2. Though the sections may be arranged differently, this particular arrangement is the most effective for developing soccer skills, as the area of the target covered by the shaded sections roughly corresponds to the area of a soccer goal which is the most difficult to defend by a goalkeeper. In addition to the colors, the target sections may also have point values indicated therein. As shown in FIG. 1, the point values correspond roughly to the degree of difficulty of hitting that particular section.

Figure 6:
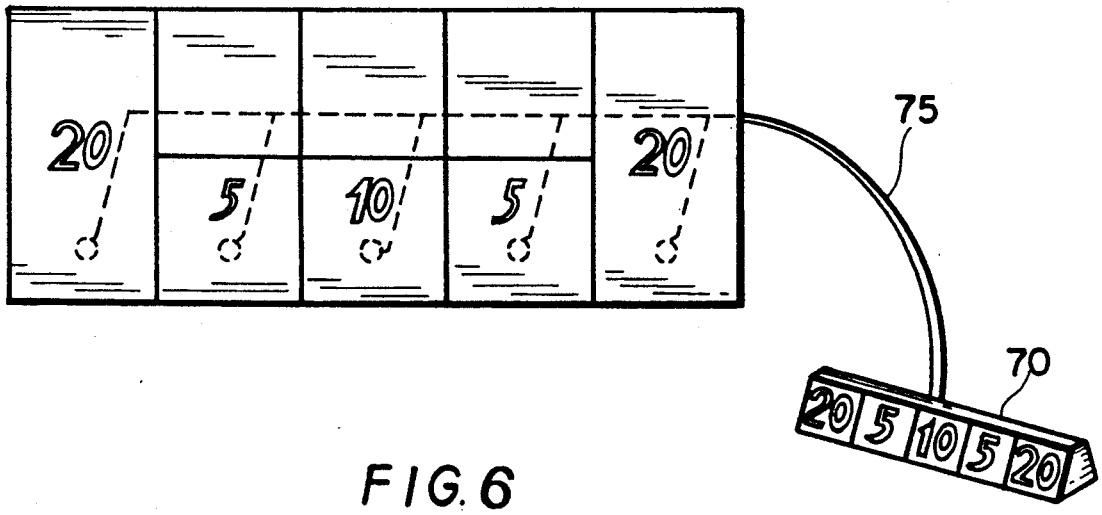
FIG. 6 is a perspective view of an embodiment having an automatic scoring indicator for use with the target shown in FIG. 1.

Additionally, as shown in FIG. 6, the target may be deployed in conjunction with an automatic scoring device 70. The scoring device is electrically connected 75 to each of the sections on the target so that when the player hits one of the sections with the ball, an indicator on the scoring device shows which target section has been hit and/or the points achieved for that hit. In the embodiment shown, the device 70 consists of five panels corresponding in color and point value to the five sections of the target. When a section is hit, an electrical connection is made and the corresponding panel lights up. The scoring device can also be a digital score indicator.

Figure 4:
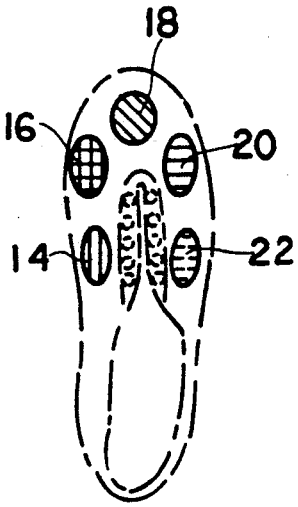
FIG. 4 is a perspective view of a shoe adapted for use in the game of the invention.

FIG. 4 shows a shoe adapted for use with the game of the invention. The shoe 24 has placed thereon, means, in this case five stickers or Velcro®-backed patches 14,16,18,20,22, which are color-coordinated with the five sections 4,6,8,10,12 of the target. FIG. 3 shows a shoe 44 especially adapted for use with the game. Shoe portions 14, 16, 18, 20, 22 are made of different colors, each portion corresponding to the inside 34, outside 36, instep 38, outstep 40 and front 42 of the shoe. The sticker or patch placement in FIG. 4 should generally correspond to these five shoe portions. The stickers or patches may be placed in the various locations so as to provide the maximum learning benefit. In other words, if a player has the most difficulty kicking a soccer ball with the outstep the sticker or patch corresponding to one of the outer target portions 4,10 can be placed on the outstep portion of the shoe.

Figure 2:
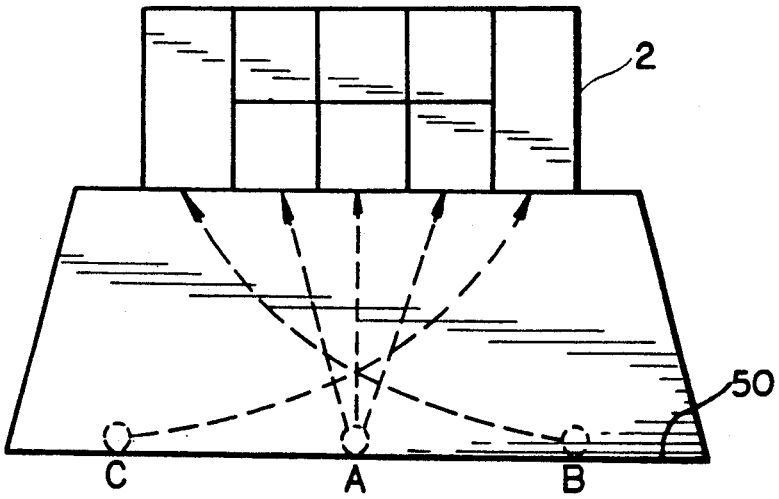
FIG. 2 is a perspective view of an embodiment of the game of the invention, showing the target of FIG. 1.

FIG. 2 shows the game of the invention being played. A kicking line 50 is set up parallel to and at a distance from the target. In a simple version of the game, single kicking point indicated by the letter A is used. The player places the ball on point A, chooses a target section, and kicks the ball toward that section with the corresponding portion of the shoe. If the chosen target section is hit, the point value indicated for the section is awarded to the player. A more challenging embodiment of the game involves additional kicking points B,C along the kicking line 50. As seen in the figure, point C is used as a kicking point for the farthest section 12 therefrom and point B is used for the farthest section 4 therefrom. Point A is used for target sections 6,8,10. Positions on the kicking line may be varied to change the degree of difficulty.

While the game herein described constitutes a preferred embodiment of the invention, it is to be understood that the invention is not limited to this precise game and that changes may be made without departing from the scope of the invention which is defined in the appended claims.

What is claimed is:

1. A game for practicing soccer skills by kicking a ball towards a target, the game comprising:

a target divided into sections, the target having means for differentiating each section from the others, and means for differentiating portions of a shoe worn by a player of the game so that each portion of the shoe corresponds to a section of the target, whereby a player is awarded points by kicking a ball at a set distance from the target with a chosen one of said portions of the shoe to hit the section of the target corresponding to said chosen portion of the shoe, each section having a given point value.

2. The game of claim 1, wherein the target is a rectangle having a length slightly less than half its height so as to resemble the shape of a soccer goal.

3. The game of claim 2, wherein the target is approximately 110 cm in length and approximately 60 cm in height.

4. The game of claim 1, wherein the number of target sections and the number of shoe portions coordinated therewith are equal.

5. The game of claim 4, wherein there are five target sections and five shoe portions.

6. The game of claim 1, wherein the unique target differentiating means and the corresponding shoe portion differentiating means are colors.

7. The game of claim 1, wherein the unique target differentiating means and the corresponding shoe portion differentiating means are numbers.

8. The game of claim 1, wherein the unique target differentiating means and the corresponding shoe portion differentiating means are designs.

9. The game of claim 1, wherein there are five target sections and five shoe portions corresponding thereto, the target differentiating means and the shoe portion differentiating means being five different colors, and the shoe portion differentiating means comprises a set of five different colored stickers or Velcro®-backed patches for attachment to the shoe in various locations.

10. The game of claim 1, wherein the shoe portion differentiating means is part of a shoe structure.

11. The game of claim 1, wherein the shoe portion differentiating means comprises a set of identifiers for attaching to different portions of a shoe.

12. The game of claim 11, wherein the identifiers are stickers.

13. The game of claim 11, wherein the identifiers are Velcro®-backed patches.

14. The game of claim 2, wherein the target comprises vertically oriented sections.

15. The game of claim 14, wherein the target comprises at least five vertically oriented sections.

16. The game of claim 15, wherein the sections are of equal length, and the two outermost sections are approximately equal in height to the target and the three innermost sections are approximately equal to half the height of the target and are located in the lower half of the target.

17. The game of claim 16, wherein the target comprises five sections.

18. The game of claim 1, further comprising an indicator which automatically shows when a particular target section has been hit by the ball.

* * * * *